US006036608A

United States Patent [19]

Morris

[11] Patent Number: 6,036,608

[45] Date of Patent: Mar. 14, 2000

[54] GOLF PUTTING AND CHIPPING TRAINING APPARATUS

[76] Inventor: John K. Morris, 3125 Hunting Valley, Ann Arbor, Mich. 48104

[21] Appl. No.: 09/306,918

[22] Filed: May 7, 1999

[51] Int. Cl.[7] ..... A63B 69/36

[52] U.S. Cl. ..... 473/220; 473/151

[58] Field of Search ..... 473/150, 151, 473/220, 221, 251, 152, 409; 434/252

[56] References Cited

U.S. PATENT DOCUMENTS

| | | | |
|---|---|---|---|
| 3,953,034 | 4/1976 | Nelson | 273/186 |
| 4,997,189 | 3/1991 | Perkins | 273/181 H |
| 5,029,868 | 7/1991 | Cloud | 273/186 C |
| 5,169,150 | 12/1992 | Tindale | 273/187.4 |
| 5,330,188 | 7/1994 | Reimers | 273/186.1 |
| 5,465,972 | 11/1995 | Cornett | 273/186.3 |
| 5,527,041 | 6/1996 | Terry, III et al. | 473/150 |
| 5,560,607 | 10/1996 | Macroglou | 273/210 |
| 5,692,965 | 12/1997 | Nighan, Jr. et al. | 473/220 |
| 5,707,296 | 1/1998 | Hodgson et al. | 473/220 |
| 5,709,609 | 1/1998 | Carney | 473/220 |
| 5,725,439 | 3/1998 | Halsey et al. | 473/220 |
| 5,738,595 | 4/1998 | Carney | 473/209 |
| 5,788,588 | 8/1998 | Hooker | 473/409 |
| 5,810,674 | 9/1998 | Falossi et al. | 473/220 |
| 5,818,036 | 10/1998 | Daly | 250/216 |
| 5,848,944 | 12/1998 | Brannen | 473/409 |
| 5,860,871 | 1/1999 | Marley, Jr. | 473/218 |
| 5,938,537 | 8/1999 | Liu | 473/192 |

*Primary Examiner*—Kien T. Nguyen
*Attorney, Agent, or Firm*—Gifford, Krass, Groh, Sprinkle, Anderson & Citkowski, PC

[57] ABSTRACT

Golf training apparatus adapted for use with a golf ball and a putter or chipping club having a club head defining a club width includes a U-shaped base having a pair of parallel, substantially rigid side members with a region therebetween which is devoid of base material. A light source, preferably a self-contained, battery operated laser, is mounted with respect to the proximal end portion, preferably at a central location so as to output a light beam proximally to distally along a line substantially parallel to the rigid side members. A momentary contact switch is preferably used to activate the light source. Using such a configuration, the base may be placed on a playing surface and the switch momentarily depressed to illuminate a target with the light beam. By virtue of the open swing region, a ball may then be placed directly on the playing surface before striking in the direction of the target.

5 Claims, 1 Drawing Sheet

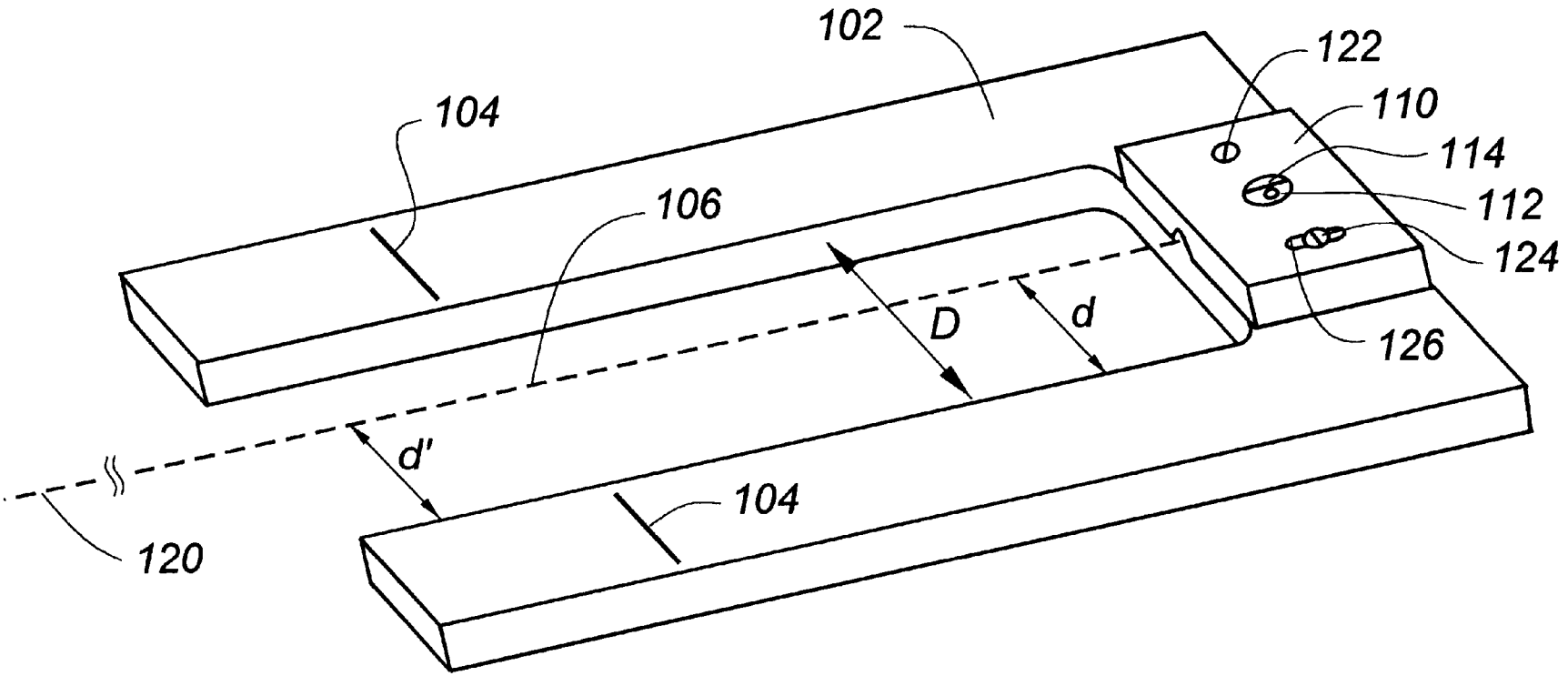
Figure

GOLF PUTTING AND CHIPPING TRAINING APPARATUS

FIELD OF THE INVENTION

This invention relates generally to golfing and, more particularly, to an apparatus and method of use intended to foster a more consistent putt or chip swing using an optical alignment system.

BACKGROUND OF THE INVENTION

There are a large number of golf training devices which are patented, on the market, or both. Indeed, golf equipment and training devices are one rf the most fertile areas for inventive minds.

U.S. Patent No. 5,527,041 to Terry, III et al, entitled "Golf Putting Trainer," features a support base with a light source attached thereto. The source is used to generate a planar-shape beam of light which is projected toward a target on the ground, such as a hole or cup. The light source includes a laser and a cylindrically shaped optical element placed transversely to the light beam to create the planar-shaped output beam. A pair of removable, attachable, elongated guide rails provide a guide path for the golfer to move the golf head to putt the ball from the top of the support base.

Although the apparatus just described has certain advantages, it reveals certain shortcomings as well. For one, the apparatus overall is quite expensive, and would therefore need to sell for a considerable amount of money in the consumer market. Secondly, since the ball is placed on a platform, it is not placed directly on a playing surface. As a consequence, the user's body would not be in precisely the same position as it would be when putting a ball directly onto a playing surface, whether that surface is a carpet or a golf green. Thirdly, since the source is mounted on the distal-most end of the apparatus, alignment is made more difficult, since the beam cannot be readily compared to the parallel side rails.

The need therefore remains for a golf putting trainer of this type, but one wherein the apparatus overall is simplified, while allowing a ball to be placed directly on a playing surface and the light source easily aligned.

SUMMARY OF THE INVENTION

The subject invention resides is golf training apparatus adapted for use with a golf ball and a putter or chipping club having a club head defining a club width. In a preferred embodiment, such apparatus comprises a U-shaped base having a pair of parallel, substantially rigid side members defining a swing region therebetween which is devoid of base material. A light source, preferably a self-contained, battery operated laser, is mounted with respect to the proximal end portion, preferably at a central location so as to output a light beam proximally to distally along a line substantially parallel to the rigid side members.

A momentary contact switch is preferably used to activate the light source. Using such a configuration, the base may be placed on a playing surface and the switch momentarily depressed to illuminate a target with the light beam. By virtue of the open swing region, a ball may then be placed directly on the playing surface before striking in the direction of the target.

BRIEF DESCRIPTION OF THE DRAWINGS

The drawing illustrates a preferred embodiment of the invention as seen from an oblique perspective.

DETAILED DESCRIPTION OF THE DRAWINGS

Making reference to the drawing, a U-shaped base 102 is oriented with the ends of the U pointing toward the cup or hole, as the case would be based upon indoor versus outdoor use of the device. The distance "D" is preferably just large enough to accommodate the widest putter heads, which may be on the order of 5 inches. This spacing is intentional, since to promote a very controlled swing it is desirable to move the club head parallel to outer parallel members without touching them. The lines 104 are used to indicate where the ball should be placed; namely, at point 106 so that as the putter swings the club will not strike any of the apparatus.

On top of the rightmost end of the bottom of the U is a block 110 and mounted therein is a laser 112. A momentary contact switch 114 is depressed to generate the laser beam 120. The laser holding block is preferably fastened to the base with a first screw 122 and a second screw 124 which is contained within a slot 126, allowing a user to loosen both screws and pivot the block to align the beam relative to the parallel side members. In particular, by measuring the distance "d," a user can easily confirm equivalence to d', as the case would be for a parallel condition. Alternatively, the laser could be factory-set in such a way that alignment would never be necessary.

In use, assuming the beam is aligned, the user places the ends of the U in the direction of the hole. The button 114 is depressed to produce the laser line 120, which then shines on the hole or other surface. For example, the hole could be positioned just in front of a wall or other object to help see the laser spot. The actual putt follows this, relying on the parallel sides of the base to ensure that the device is pointing directly toward the hole. Alternatively, by virtue of the open-ended U design, a chipping club can be used and swung through the open end after striking the golf ball.

I claim:

1. Golf training apparatus adapted for use with a golf ball and a putter or chipping club having a club head defining a club width, the apparatus comprising:

a U-shaped base having a pair of parallel, substantially rigid side members spaced apart by an amount somewhat greater than the club width, each side member having a proximal end and a distal end, the two proximal ends being attached to a proximal end portion, and the two distal ends being free and unattached, thereby defining a swing region between the members distally of the proximal end portion which is devoid of base material;

a light source mounted with respect to the proximal end portion, the source outputting a light beam proximally to distally along a line substantially parallel to the rigid side members; and a momentary contact switch used to activate the light source, whereby the base may be placed on a playing surface and the switch momentarily depressed to illuminate a target with the light beam, and the ball may be placed directly on the playing surface within the swing region to putt or chip the ball towards the target.

2. The apparatus of claim 1, wherein the light source is mounted central with respect to the proximal end portion, such that the beam is emitted substantially between the side members.

3. The apparatus of claim 1, wherein the light source is a laser outputting a laser beam.

4. The apparatus of claim 1, further including means for adjusting the light source relative to the base to ensure that the beam is parallel to the side members.

5. Golf training apparatus adapted for use with a golf ball and a putter or chipping club having a club head defining a club width, the apparatus consisting of:

a U-shaped base having a pair of parallel, substantially rigid side members spaced apart by an amount somewhat greater than the club width, each side member having a proximal end and a distal end, the two proximal ends being attached to a proximal end portion, and the two distal ends being free and unattached, thereby defining a swing region between the members distally of the proximal end portion which is devoid of base material;

a laser mounted with respect to the proximal end portion, the laser outputting a light beam proximally to distally along a line substantially parallel to the rigid side members; and a momentary contact switch used to activate the laser.

* * * * *